US008064808B2

(12) United States Patent
Anan et al.

(10) Patent No.: US 8,064,808 B2
(45) Date of Patent: Nov. 22, 2011

(54) DEVELOPING ROLLER, AND ELECTROPHOTOGRAPHIC PROCESS CARTRIDGE AND ELECTROPHOTOGRAPHIC IMAGE FORMING APPARATUS COMPRISING THE DEVELOPING ROLLER

(75) Inventors: Genya Anan, Numazu (JP); Kenichi Yamauchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 12/538,363

(22) Filed: Aug. 10, 2009

(65) Prior Publication Data

US 2010/0046989 A1 Feb. 25, 2010

(30) Foreign Application Priority Data

Aug. 25, 2008 (JP) ..... 2008-215267

(51) Int. Cl.
*G03G 15/10* (2006.01)
*G03G 15/08* (2006.01)

(52) U.S. Cl. ..... 399/286; 399/239

(58) Field of Classification Search ..... 399/239, 399/265, 279, 286
See application file for complete search history.

(56) References Cited

U.S. PATENT DOCUMENTS

| | | | | |
|---|---|---|---|---|
| 4,687,723 | A * | 8/1987 | Ohshima et al. | 430/65 |
| 4,957,839 | A * | 9/1990 | Rokutanzono et al. | 430/66 |
| 6,549,223 | B2 | 4/2003 | Yamauchi | 347/132 |
| 6,674,975 | B2 | 1/2004 | Yamauchi | 399/12 |
| 6,850,714 | B2 | 2/2005 | Sakurai et al. | 399/25 |
| 6,963,714 | B2 | 11/2005 | Otomo et al. | 399/274 |
| 7,274,884 | B2 | 9/2007 | Yamauchi | 399/25 |
| 2006/0109491 | A1 | 5/2006 | Naito et al. | 358/1.13 |

FOREIGN PATENT DOCUMENTS

| | | |
|---|---|---|
| JP | 2003-122108 | 4/2003 |
| JP | 2005-215485 | 8/2005 |
| JP | 2000-181218 | 6/2008 |

* cited by examiner

*Primary Examiner* — David Gray
*Assistant Examiner* — Joseph Wong
(74) *Attorney, Agent, or Firm* — Fitzpatrick, Cella, Harper & Scinto

(57) ABSTRACT

A developing roller has a surface layer which can effectively inhibit the bleeding of a low-molecular-weight component from an elastic layer, and can efficiently impart a high electric charge to a negatively chargeable toner, and is excellent in toner-releasing properties. The developing roller has a mandrel, at least one layer of an elastic layer provided on the mandrel and a surface layer provided on the elastic layer, carries and conveys a toner, and develops an electrostatic latent image on an opposing photosensitive member with the toner. The surface layer comprises a silicon compound film containing Si, N, C and H having specific total amounts of the existing elements Si, N, C and H, and specific ratios N/Si, C/Si, and H/Si.

10 Claims, 4 Drawing Sheets

DEVELOPING ROLLER, AND ELECTROPHOTOGRAPHIC PROCESS CARTRIDGE AND ELECTROPHOTOGRAPHIC IMAGE FORMING APPARATUS COMPRISING THE DEVELOPING ROLLER

BACKGROUND OF THE INVENTION

1. Field of the Invention

The present invention relates to a developing roller to be used in an electrophotographic image forming apparatus, such as a copying machine and a laser printer, and an electrophotographic process cartridge and an electrophotographic image forming apparatus which are provided with the developing roller.

2. Description of the Related Art

As a development method of visualizing an electrostatic latent image existing on the photosensitive drum with the use of the toner, a contact development method in which a developing roller carrying a toner is brought into contact with a photosensitive drum is known. The developing roller is required to have a function of imparting an adequate frictional charge to the toner. In the contact development method, a negatively chargeable one-component developer is generally used in many cases. In two such examples, Japanese Patent Application Laid-Open No. 2000-181218 and Japanese Patent Application Laid-Open No. 2003-122108 disclose a developing roller which uses a resin coating layer containing nitrogen in the surface layer of the developing roller, as a developing roller which can efficiently impart a high electric charge to a negatively chargeable toner.

In addition, a developing roller provided with an elastic layer is proposed in order to secure a nip width on a contacting portion with the photosensitive drum. However, in the developing roller having the elastic layer, a low-molecular-weight substance, which is unavoidably contained in the elastic layer, occasionally bleeds out to the surface. The low-molecular-weight substance having bled out adheres to the surface of the photosensitive drum, which is in contact with the developing roller, and thereby occasionally affects the quality of the electrophotographic image and the life of the photosensitive drum. As a result, Japanese Patent Application Laid-Open No. 2005-215485 discloses a developer-carrying body provided with a shielding layer which shields a bleeding material that bleeds from the elastic layer.

SUMMARY OF THE INVENTION

The present inventors made an investigation on the above described inventions described in Japanese Patent Application Laid-Open No. 2000-181218 and Japanese Patent Application Laid-Open No. 2003-122108, and consequently found that a resin layer containing nitrogen positively charges when being actually used, and the surface shows strong tacking (stickiness) properties, so that a negatively chargeable toner is apt to be deposited on the surface of the resin layer. The toner which has adhered to the surface of the developing roller gradually deteriorates through repeated processes of forming electrophotographic images, and occasionally fusion-bonds to the surface of the developing roller. The developing roller having the toner fusion-bonded on its surface occasionally lowers the quality of the electrophotographic image which has been formed by using the developing roller.

Then, the present inventors arrived at recognition that in order to enhance the degree of and further enhance the stability of an electrophotographic image according to a contact development process, it is desirable to provide a developing roller provided with such a surface layer as to satisfy at least following three points.

1. The developing roller is capable of effectively inhibiting the bleeding of the low-molecular-weight component from the elastic layer.

2. The developing roller is capable of efficiently imparting a high electric charge to a negatively chargeable toner.

3. The developing roller has a surface superior in toner-releasing properties.

Therefore, the present invention is directed to a developing roller provided with a surface layer which can satisfy the above described requirements 1 to 3. In addition, the present invention is directed to an electrophotographic process cartridge and an electrophotographic image forming apparatus which can stably form high quality electrophotographic images.

The present inventors made an extensive investigation in order to solve the above described problems, as a result, found that it is effective to specify a material for forming a surface layer, and arrived at the present invention.

According to one aspect of the present invention, there is provided a developing roller comprising a mandrel, at least one layer of an elastic layer provided on the mandrel and a surface layer provided on the elastic layer, which carries and conveys a toner, and develops an electrostatic latent image on an opposing photosensitive member with the toner. The surface layer comprises a silicon compound film containing Si, N, C and H. In the surface layer, the proportion of the total number of the existing elements of Si, N, C and H, with respect to all elements, as measured by X-ray photoelectron spectroscopy and elastic recoil detection analysis, is 90.00% or more, and the ratio N/Si of N to Si is 0.20 or more and 1.00 or less, the ratio C/Si of C to Si is 0.30 or more and 1.50 or less, and the ratio H/Si of H to Si is 0.15 or more and 0.35 or less.

According to another aspect of the present invention, there is provided an electrophotographic process cartridge which can be detachably mounted on the main body of an electrophotographic image forming apparatus. The cartridge has a developing roller as mentioned above.

According to further aspect of the present invention, there is provided an electrophotographic image forming apparatus having a photosensitive member for retaining an electrostatic latent image and a developing roller which can be arranged in contact with the photosensitive member, wherein the developing roller is a developing roller as mentioned above.

The present invention provides a developing roller having a surface layer which can prevent the bleeding of the low-molecular-weight substance from an elastic layer and can form a stable image even when having been left for a long period of time in a state of being pressed against a contacted member. The present invention also provides a developing roller which can impart a high electric charge to a toner to be negatively charged. Furthermore, the present invention provides a developing roller which can inhibit the occurrence of filming and can form a stable image.

Further features of the present invention will become apparent from the following description of exemplary embodiments with reference to the attached drawings.

DESCRIPTION OF THE EMBODIMENTS

Figure 1:
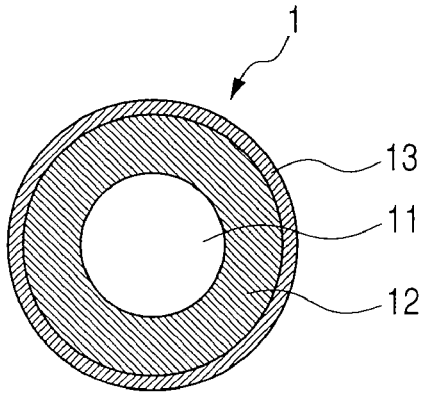
FIG. 1 is a schematic sectional view illustrating a structure example of a developing roller.

FIG. 1 is a cross-sectional view of a developing roller 1 in a direction perpendicular to an axial direction according to the present invention.

The developing roller 1 has a mandrel 11 which is a molded body of an electroconductive material, such as a metal, an elastic layer 12 and a surface layer 13 which are stacked thereon in this order.

A developing roller 1 is generally used in a state in which an electric bias is applied thereto or of being grounded.

<Mandrel>

A mandrel 11 is a supporting member, and at least the surface thereof can be electroconductive so that it is composed of an electroconductive material. For this reason, a material to be used for the peripheral face of the mandrel 11 is sufficiently electroconductive to apply a predetermined voltage to an elastic layer 12 to be formed thereon, and specifically includes, for instance, a metal or an alloy such as Al, a Cu alloy and SUS, and a material that is Cr-plated, an Ni-plated layer, or the like. The outer diameter of the mandrel 11 can be usually set at a range from 4 mm to 10 mm.

<Elastic Layer>

The elastic layer 12 is formed by using one of rubber and a resin as the main component of the raw material. Various rubbers conventionally used for a developing roller can be used as the rubber that is the main component of the raw material. Specifically, the following are cited as examples: ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, NBR hydride, polysulfide rubber, and urethane rubber.

In addition, a resin of the main component in the raw material is mainly a thermoplastic resin, and specifically includes the following: polyethylene resins such as low-density polyethylene (LDPE), high-density polyethylene (HDPE), straight-chain low-density polyethylene (LLDPE) and ethylene-vinyl acetate copolymer resins (EVA); polypropylene resins; polycarbonate resins; polystyrene resins; ABS resins; polyimide; polyester resins such as polyethylene terephthalate and polybutylene terephthalate; fluororesins; and polyamide resins such as polyamide 6, polyamide 66 and MXD6.

These rubbers and resins may be used singly or in a form of two or more of them being mixed. Among them, a liquid silicone rubber and a liquid urethane rubber can be used for a material to be used in the elastic layer, because it is important to give moderately low hardness and a sufficient deformation-recovery force to the elastic layer 12. An addition reaction cross-linking type liquid silicone rubber can be used in particular, because of having adequate processability, a high stability of dimensional accuracy, and such a superior productivity as not to produce a reaction by-product or the like in a curing reaction.

Furthermore, the material of the elastic layer includes components necessary for the functions required to the elastic layer itself, such as a conductive agent and a non-conductive filler, and various additive components to be used in forming a molded body of a rubber and a resin, for instance, such as a crosslinking agent, a catalyst and a dispersion-accelerating agent, which can be appropriately blended.

The conductive agent includes an ion conductive substance acting according to an ion conducting mechanism, and a conductivity-imparting agent acting according to an electron conducting mechanism, and one or both of the ion conductive substance and the conductivity-imparting agent can be used.

The conductivity-imparting agent acting according to the electron conducting mechanism includes the following: powders and fibers of a metal such as aluminum, palladium, iron, copper and silver; powders of metal compounds such as copper sulfide, zinc sulfide, tin oxide, antimony oxide, indium oxide, molybdenum oxide; powders of a metal such as zinc aluminum, gold, silver, copper, chromium, cobalt, iron, lead, platinum, and rhodium; metal oxides which have been subjected to doping treatment so as to have electroconductivity, such as antimony-doped tin oxide, niobium-doped titanium oxide, and aluminum-doped zinc oxide; and a carbon black type of conductive agents such as acetylene black, Ketjen Black (trade name), PAN type carbon black, pitch type carbon black and a carbon nanotube.

The ion conductive substance acting according to the ion conducting mechanism includes the following: alkali metal salts such as $LiCF_3SO_3$, $NaClO_4$, $LiClO_4$, $LiAsF_6$, $LiBF_4$, NaSCN, KSCN and NaCl; ammonium salts such as $NH_4Cl$, $NH_4SO_4$ and $NH_4NO_3$; alkaline earth metal salts such as $Ca(ClO_4)_2$ and $Ba(ClO_4)_2$; complexes of these salts with a polyalcohol such as 1,4-butanediol, ethylene glycol, polyethylene glycol, propylene glycol and polypropylene glycol, or with a derivative thereof; complexes of these salts with a monool such as ethylene glycol monomethyl ether, ethylene glycol monoethyl ether, polyethylene glycol monomethyl ether and polyethylene glycol monoethyl ether; cationic surfactants such as a quaternary ammonium salt; anionic surfactants such as an aliphatic sulfonate, an alkyl sulfate and an alkyl phosphate; and amphoteric surfactants such as betaine.

These conductive agents can be used singly or in a form of two or more of them being mixed. Among these, the carbon black type conductive agents can be used because of being easily available at a relatively low cost and also being capable of imparting adequate conductivity to the elastic layer without depending on the types of the main component in the raw material of the elastic layer. Conventionally used units, for instance, such as a roll kneader, a Banbury mixer, a ball mill, a sand grinder, a paint shaker and a biaxial extruder, may be appropriately used according to the main component of the raw material, as a unit for dispersing a fine powder of the conductive agent into the main component of the raw material. The non-conductive filler includes a filler, an extender and an oxidation inhibitor. The filler and the extender include silica, quartz fine powder, diatomaceous earth, zinc oxide, basic magnesium carbonate, active calcium carbonate, magnesium silicate, aluminum silicate, titanium dioxide, talc, mica powder, aluminum sulfate, calcium sulfate, barium sulfate, glass fiber, an organic reinforcing agent and an organic filler. The surfaces of these fillers and extenders may be treated with an organosilicon compound to acquire hydrophobicity thereon.

Known oxidation inhibitors used for a polymer compound, such as a hindered phenol-based oxidation inhibitor, a phenol-based oxidation inhibitor, a phosphorus-based oxidation inhibitor, an amine-based oxidation inhibitor and a sulfur-based oxidation inhibitor, can be appropriately selected and used as an oxidation inhibitor.

Known materials can be used as processing auxiliaries. Specifically, for instance, fatty acids such as stearic acid and oleic acid, and metal salts and esters of fatty acids can be used.

The elastic layer can be prepared from silicone rubber, for instance, by using liquid silicone rubber as a main agent, polyorganohydrogen siloxane as a crosslinking component, and a platinum-based catalyst to crosslink the rubber components with each other.

The thickness of the elastic layer can be at least 0.5 mm or more and further can be 1.0 mm or more, in order that the elastic layer can achieve the function of securing a nip width between the elastic layer and a photosensitive drum. The specific thickness of the elastic layer may be appropriately determined according to the hardness of the rubber in order to achieve the aiming nip width, but practically, the thickness of the elastic layer is generally set at 6.0 mm or less.

The elastic layer 12 can be formed by conventionally-known extrusion methods, injection molding methods and the like, but the method of forming the elastic layer is not particularly limited. The elastic layer may be constituted by two or more layers.

The elongation modulus of the elastic layer can be 1.0 MPa or more and 100.0 MPa or less, and further can be 1.0 MPa or more and 30.0 MPa or less. When the elongation modulus of the elastic layer is set at 1.0 MPa or more, even if the developing roller is left, for instance, in a state of contacting a contacted member for a long period of time, the developing roller can inhibit its contacting portion from causing a pressure-contact permanent deformation. In addition, when the elongation modulus of the elastic layer is set at 100 MPa or less, the developing roller can prevent the contact width between the developing roller and the contacted member from becoming excessively small, and can prevent the pressure applied to the toner which passes in between the contacted members from becoming excessively large. Therefore, the developing roller can inhibit an in-use toner from causing the detachment or embedment of the external additive (fine powder deposited on surface of toner for the purpose of imparting charging properties, flowing properties and the like to toner), causing the bleeding of wax and the like in the toner, and causing filming.

Figure 2:
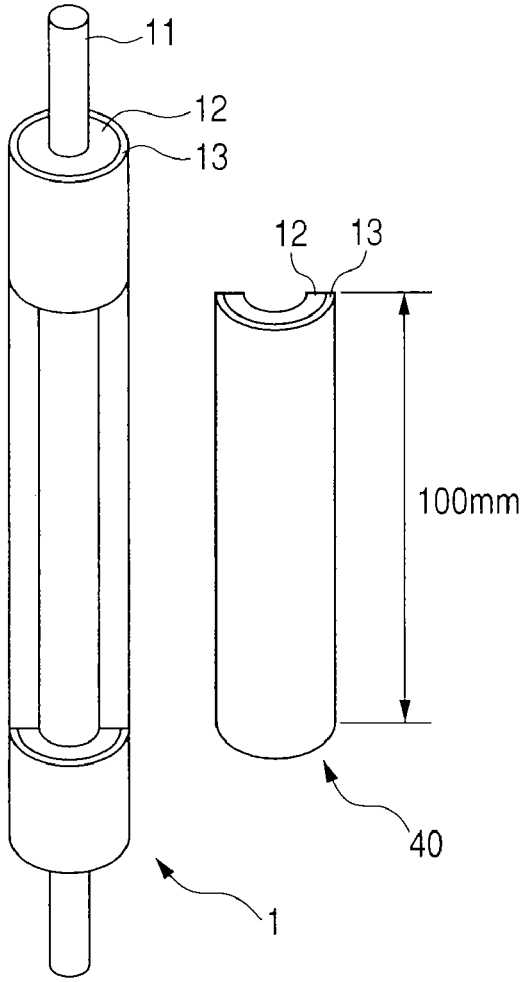
FIG. 2 is an explanatory view illustrating a method of collecting a test piece for the measurement of an elongation modulus.

The elongation modulus in the present invention is measured according to the method described in Japanese Industrial Standards (JIS) K7113 (1995). However, in the present invention, as illustrated in FIG. 2, a sample is cut out from the developing roller 1 so as to have a length of 100 mm and corresponds to the half of the perimeter of the roller, and is used as a test piece 40 for measuring the elongation modulus.

The universal tensile tester "TENSILON RTC-1250A" (which is trade name and is made by ORIENTEC CO., LTD.) is used for measurement, and the measurement environment is set at a temperature of 20±3° C. and a humidity of 60±10% RH. Then, measurement is performed by setting 10 mm of each end of the test piece in a chuck, setting a length between chucks at 80 mm and setting a measurement speed at 20 mm/min, and then calculating the elongation modulus. The average value is calculated from the values of five specimens and is defined as the elongation modulus of the test piece.

<Surface Layer>

A surface layer 13 is made of a silicon compound film which contains elements such as Si, N, C and H as a main component. In the silicon compound film, the total number of the existing elements of Si, N, C and H occupying in all elements is 90.00% or more, and the ratio of N to Si (N/Si), the ratio of C to Si (C/Si) and the ratio of H to Si (H/Si) are as follows.

N/Si is 0.20 or more and 1.00 or less, C/Si is 0.30 or more and 1.50 or less, and H/Si is 0.15 or more and 0.35 or less.

When N/Si is less than 0.20, it is difficult to impart an appropriate electric charge to a toner, so that fogging is apt to occur. When N/Si is more than 1.00, the developing roller acquires excessively high properties of imparting the frictional charge to the toner. Therefore, the toner is excessively charged, in other words, causes charge-up, and is not uniformly supplied to the surface of the developing roller and not uniformly scraped therefrom, so that a so-called a ghost phenomenon is apt to occur.

If C/Si was less than 0.30, the surface layer would become hard and brittle, and would be apt to cause a crack therein when having been in contact with a photosensitive drum and the like. As a result, a low-molecular-weight substance which is contained in the elastic layer bleeds, and occasionally adheres to a photosensitive drum. In addition, when C/Si is more than 1.50, the adhesiveness of the surface layer to the elastic layer is lowered, and the surface layer is apt to be peeled from the elastic layer. Furthermore, when H/Si is less than 0.15, the surface layer also tends to be hardened. In addition, when H/Si exceeds 0.35, the strength of the surface layer decreases, which leads to the falling off of the surface layer from the elastic layer.

The amount ratio of the elements in the surface layer is obtained in the following way.

The amount ratio of all the elements except light elements can be measured by X-ray photoelectron spectroscopy with the use of an X-ray photoelectron spectrometer (trade name: Quantum 2000; made by ULVAC-PHI, Inc.). Then, peaks originating in the bonding energy of the 2p orbit of Si and the Is orbit of N and C on the surface of a silicon compound film as the surface layer of the developing roller are measured by using $AlK_{\alpha}$ (1.487 keV) as an X-ray source. The amount ratio of the respective elements is calculated from each peak, and N/Si and C/Si are determined from the obtained amount.

On the other hand, light elements such as a hydrogen atom can be measured by using an ERDA mode (elastic recoil detection analysis) of a middle energy ion beam analyzer (trade name: HRBS500; made by Kobe Steel, Ltd.). The light element is measured on the condition of making an He ion which has been accelerated to 500 keV incident on the surface layer of the developing roller at the incidence angle of 75 degrees, and by detecting the concentration of hydrogen which has been recoiled by the incident He ion.

The total amount of Si, N, C and H with respect to all elements which are contained in the surface layer is 90.00% or more. When the total amount is less than 90.00%, the silicon compound does not form the silicon compound film, and exists on the surface of the elastic layer in a state of being interspersed in an island shape. Therefore, the silicon compound cannot inhibit the low-molecular-weight substance which is contained in the elastic layer from bleeding to the surface of the developing roller.

In addition, the silicon compound film which constitutes the surface layer may also contain another element in addition to the above described each element (Si, N, C and H). Specifically, the silicon compound film can contain an oxygen atom from the viewpoint of its stability. When the oxygen occupies 1.00% or more by a ratio with respect to all the elements, the durability of the silicon compound film becomes more satisfactory, and the surface layer can be more effectively inhibited from being peeled off from the elastic layer.

A method for forming a surface layer, for instance, includes a wet coating method (dip coating method, spray coating method, roll coating method, ring coating method and the like), a physical vapor deposition (PVD) method (a vacuum vapor-deposition method, a sputtering method, an ion plating method and the like), and a chemical vapor deposition (CVD) method (a plasma CVD method, a thermal CVD method, a laser CVD method and the like).

Among the above described methods, the plasma CVD method in particular can be employed. This is because the obtained surface layer (silicon compound film) shows particularly adequate uniformity and particularly adequate adhesiveness to the elastic layer. The plasma CVD method is more advantageous than other methods because the CVD method can be performed for a short period of time, at a low temperature, and uses a simple apparatus, and the like.

Figure 3:
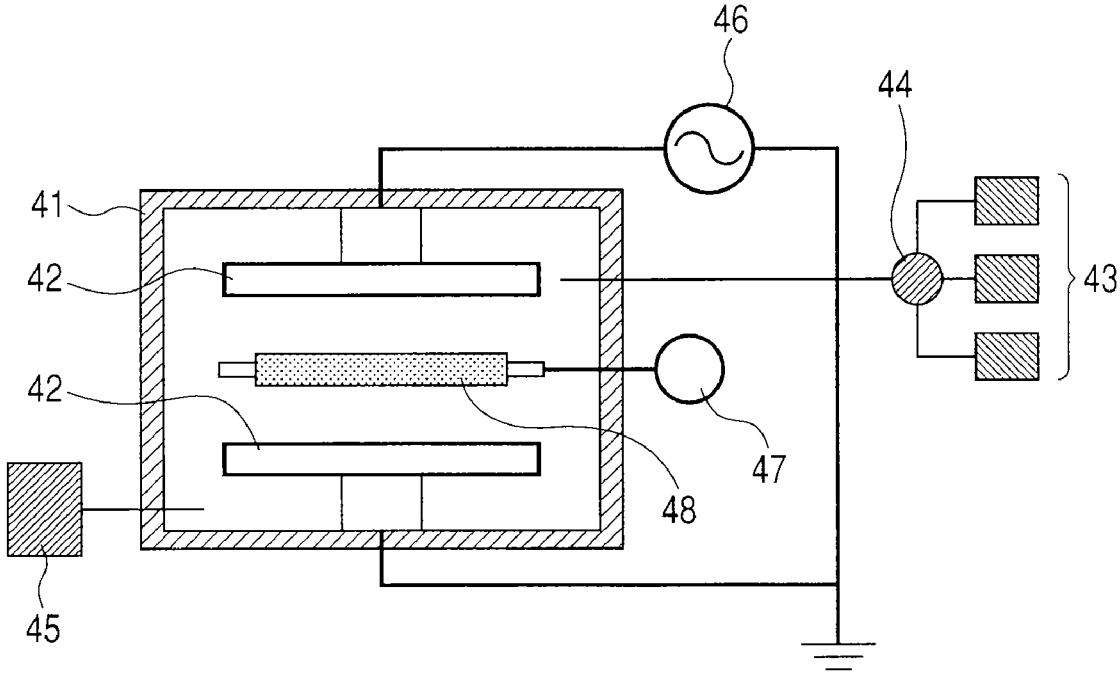
FIG. 3 is a schematic view of a plasma CVD apparatus.

A method for forming a surface layer by the plasma CVD method will now be described below. FIG. 3 is an explanatory drawing of a film-forming apparatus for forming the surface layer by this plasma CVD method.

The film-forming apparatus includes a vacuum chamber 41, two plate electrodes 42 placed in parallel to each other, a raw material gas cylinder and raw material liquid tanks 43, a raw material supply unit 44, a unit 45 for exhausting the gas in the chamber, a high-frequency supply power source 46 for supplying a high-frequency power, and a motor 47 for rotating an elastic roller 48.

A developing roller according to the present invention can be manufactured according to the following procedures while using the apparatus.

Procedure (1): Place the elastic roller 48 whose peripheral surface on the mandrel 11 has been covered with the elastic layer 12 in between the plate electrodes 42, and rotate the elastic roller 48 in a circumferential direction by driving the motor 47 so that a silicon compound film (surface layer) to be obtained is uniform.

Procedure (2): Evacuate the inside of the vacuum chamber 41 by operating the exhaust unit 45.

Procedure (3): Introduce a raw material gas from the raw material supply unit 44, supply high-frequency power to the plate electrodes 42 from the high-frequency supply power source 46 to generate plasma, and form a silicon compound film.

Procedure (4): Stop the supply of the raw material gas and the high-frequency power, after a predetermined period of time has passed, introduce (leak) air or nitrogen into the vacuum chamber 41 until reaching atmospheric pressure, and then take out the elastic roller 48, specifically, the developing roller 1, whose elastic layer 12 has a peripheral surface that has been covered with the surface layer 13.

The developing roller having the surface layer made of the silicon compound film can be manufactured by performing the above described procedures (1) to (4). For information, many elastic rollers 48 may be simultaneously treated by plasma CVD if they could be placed in a uniform plasma atmosphere.

A gaseous or gasified organosilicon compound is usually introduced into the vacuum chamber 41 as the raw material gas, together with a hydrocarbon compound as needed, in the coexistence of or in the absence of gas such as an inert gas and an oxidizing gas.

Here, the organosilicon compound includes, for instance, the following:

1,1,3,3-tetramethyldisiloxane, hexamethyldisiloxane, hexamethyldisilazane, vinyltrimethylsilane, methyltrimethoxysilane, hexamethyldisilane, methylsilane, dimethylsilane, trimethylsilane, tetramethylsilane, diethylsilane, propylsilane, phenylsilane, vinyltriethoxysilane, vinyltrimethoxysilane, tetramethoxysilane, tetraethoxysilane, phenyltrimethoxysilane, methyltriethoxysilane, and octamethylcyclotetrasiloxane.

Among the above described organosilicon compounds, 1,1,3,3-tetramethyldisiloxane, hexamethyldisiloxane and tetramethylsilane can be used, because they are easily handled. Furthermore, hexamethyldisilazane can be used more as a material containing nitrogen.

A silane source is not limited to the organosilicon compound. Silane, aminosilane and silazane can also be used.

When the organosilicon compound and the like are gaseous, they are used as they are. When the organosilicon compound and the like are liquid at room temperature, they are heated, vaporized, and conveyed by an inert gas, or bubbled by an inert gas and conveyed for use. Furthermore, when an organosilicon compound and the like are solid at room temperature, they are heated, vaporized and conveyed by an inert gas for use. In addition, the vaporization of the raw material substances may be accelerated by being placed in a state of a reduced pressure.

A nitrogen-containing gas ($N_2O$, $N_2$, ammonia and the like) or an oxygen-containing gas (oxygen, $CO_2$, CO and the like) can also be introduced into the vacuum chamber, together with the above described raw material gas, or in addition to the raw material gas. In addition, an inert gas that can be used in the above process includes helium and argon.

The amounts of Si, N, C and H in the surface layer can be controlled by controlling the blending ratio of the raw material gases to be introduced, the flow rates when the raw material gases are introduced, and the high-frequency power to be supplied.

In addition, a method for forming a silicon compound film (surface layer) with a wet process can employ a method of uniformly applying a mixture of an inorganic polymer precursor solution and a solution of a polymer having a hydroxyl group onto an elastic layer, and then applying a curing unit such as heating or ultraviolet irradiation to the coated film.

Here, the surface of the elastic layer may be subjected to ultraviolet irradiation, electron beam irradiation or activation treatment such as plasma treatment, before the raw material mixture for a surface layer is applied onto the elastic layer, so that the mixture can be uniformly applied.

The film thickness of the surface layer formed in this manner can be 15 nm or more and 5,000 nm or less, and further can be 300 nm or more and 3,000 nm or less. When the film thickness of the surface layer is set at 5,000 nm or less, the production period of time does not become excessively long, the temperature of the elastic layer does not excessively rise during production, and the shape when the elastic layer is formed can be maintained even if the elastic layer is made from a material having a low melting point such as a thermoplastic resin. Therefore, when the developing roller has been used in printing, the obtained image hardly causes an ill effect of density non-uniformity therein.

In the above description, the film thickness of the formed surface layer is defined as an average value of values obtained by having measured 9 spots in total of 3 spots equally spaced in the peripheral direction of the developing roller for each of 3 spots equally spaced in the lengthwise direction from an end portion, by using a thin film measurement instrument (trade name: F20-EXR; made by Filmetrics, Inc.).

Figure 4:
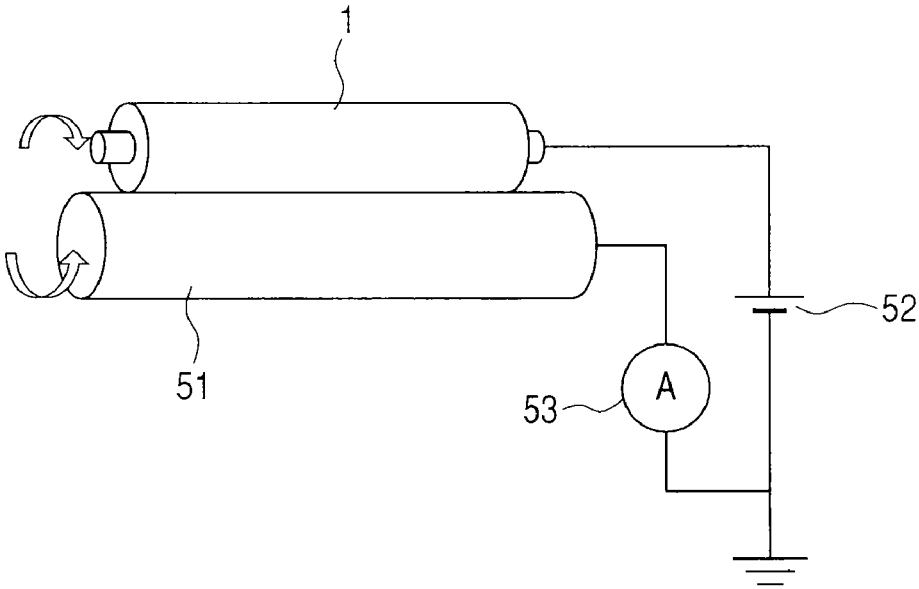
FIG. 4 is an explanatory view illustrating a method for measuring the current value of the developing roller.

In the developing roller according to the present invention, the current value measured when DC 50 V is applied to the developing roller which is rotating, by using the apparatus illustrated in FIG. 4, can be 5 μA or more and 5,000 μA or less, and further can be 10 μA or more and 500 μA or less. When the current value is 5 μA or more, a developing bias sufficient for development can be easily obtained when an image is developed on a photosensitive member with a toner, and the obtained image can have sufficient image density. When the current value is 5,000 μA or less, a bias leak hardly occurs even though pinholes are formed on the surface of the photosensitive member, and transverse streaks hardly appear on the image to be obtained.

A method of measuring the current value of a developing roller with the use of an apparatus illustrated in FIG. 4 will now be described. The outer peripheral surface of a developing roller 1 is in contact with a cylindrical electrode 51 which is made from SUS and has a diameter of 40 mm, by applying a load of 500 g to each of exposed portions of the mandrel of the developing roller 1. The cylindrical electrode 51 is rotated in this state, and the developing roller 1 is rotated in the circumferential direction at the speed of 24 rpm by associated rotation. When the rotation becomes stable, voltage is applied to the mandrel from a direct-current power source 52, and the voltage of 50 V is applied between the mandrel and the cylindrical electrode. The environment at this time shall be 20° C. and 50% RH. Current values of the developing roller 1 by one rotation are measured with an ammeter 53, and the average value of the current values is defined as the current value. In the present specification, the current value measured in this manner is referred to as "the current value of the developing roller". It is important to control this current value of the developing roller properly and uniformly, in terms of keeping the strength of an electric field for toner movement proper and uniform.

The developing roller according to the present invention is useful as a developing roller of an image forming apparatus, such as a copying machine, a facsimile and a printer, and also as a developing roller of a process cartridge in a process cartridge type of an image forming apparatus.

Figure 5:
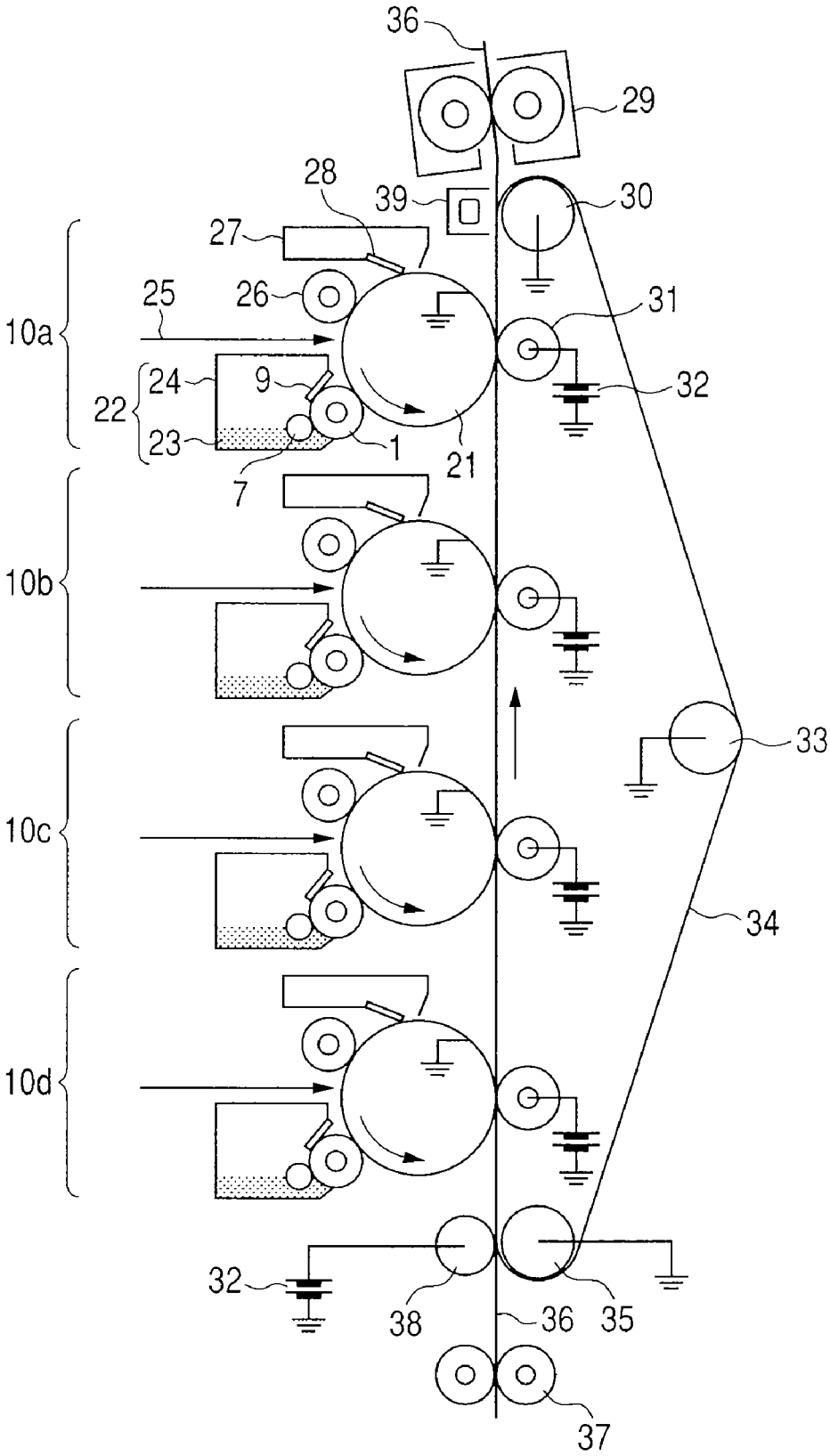
FIG. 5 is a schematic view illustrating one example of a developing apparatus having a developing roller according to the present invention mounted thereon.

One example of a color electrophotographic image forming apparatus having the developing roller according to the present invention mounted thereon is illustrated in FIG. 5. The color electrophotographic image forming apparatus will now be described below with reference to FIG. 5.

The color electrophotographic image forming apparatus illustrated in FIG. 5 has image forming portions 10*a*, 10*b*, 10*c* and 10*d*, which are provided for color toners of yellow Y, magenta M, cyan C and black BK, respectively, in a tandem form. Each of the image forming portions 10*a* to 10*d* basically has the same structure. Each of the image forming portions is provided with a photosensitive drum 21 which functions as a latent image carrying member and rotates in the direction of the arrow located on the drums 21. A charging member 26 for electrically charging the photosensitive drum 21, a light exposure unit for irradiating an electrically charged photosensitive drum 21 with a laser light 25 to form an electrostatic latent image thereon, and a developing apparatus 22 which supplies a toner to the photosensitive drum 21 and develops the electrostatic latent image that has been formed on the photosensitive drum 21 are provided around the photosensitive drum 21. Furthermore, a transfer member is provided which has a transfer roller 31 for transferring a toner image existing on the photosensitive drum 21 onto a recording medium 36 such as paper, which is fed by a pair of paper feed rollers 37 and conveyed by a conveying belt 34, from the back surface of the recording medium 36 by voltage applied from a bias power source 32 thereto. The conveying belt 34 is suspended by a driving roller 30, a driven roller 35 and a tension roller 33, and is so controlled as to move in synchronization with the image forming portions and convey the recording medium 36 so that the toner images formed in the respective image forming portions are sequentially superposed and transferred onto the recording medium 36. The recording medium 36 is electrostatically held to the conveying belt 34 by the operation of an adsorption roller 38 placed right before the conveying belt 34, and is conveyed.

Furthermore, the color electrophotographic image forming apparatus is provided with a fixing apparatus 29 for fixing the toner images which have been superposed and transferred onto the recording medium 36, by heating or the like, and a conveying apparatus (not illustrated) for ejecting the recording medium having the image formed thereon, out of the color electrophotographic image forming apparatus. The recording medium 36 is peeled from the conveying belt 34 by the operation of a peeling apparatus 39 and is sent to the fixing apparatus 29.

On the other hand, the image forming portion 10 is provided with a cleaning member having a cleaning blade 28 which removes the transfer residual toner that has not been transferred to the recording medium and remains on the photosensitive drum 21 to clean the surface, and a waste toner container 27 for storing the toner therein which has been scraped off from the photosensitive drum. Further, the photosensitive member 21, the charging member 26, the developing apparatus 22, the cleaning blade 28 and the waste toner container 27 can also be integrated into a process cartridge which is releasably formed on the main body of the electrophotographic image forming apparatus.

The developing apparatus 22 installed in the above described image forming portion 10 is provided with a toner container 24 which accommodates a negatively chargeable one-component developer therein functioning as a toner 23, and with a developing roller 1. The developing roller 1 is arranged so as to block the opening of the toner container 24 and so as to oppose to the photosensitive drum 21 in the portion exposed from the toner container 24. The toner container 24 is provided with a roller-shaped toner-applying member 7 which is in contact with the developing roller 1 and supplies the toner to the developing roller 1, and a toner-amount-regulating blade 9 which forms the toner supplied to developing roller 1 into a thin film and imparts a frictional charge to the toner. A specific structure of the toner-applying member 7 includes, for instance, one in which a foam sponge or polyurethane foam is provided on a shaft body, and one having a fur brush structure in which fibers of for example, rayon or polyamide are implanted. The above structures can be used because a residual toner on the developing roller 1 can be sufficiently removed. The toner-applying member 7 can be arranged so as to have a suitable contact width on the developing roller 1, and can be rotated in the direction counter to the developing roller 1 in the contacting portion.

Figure 6:
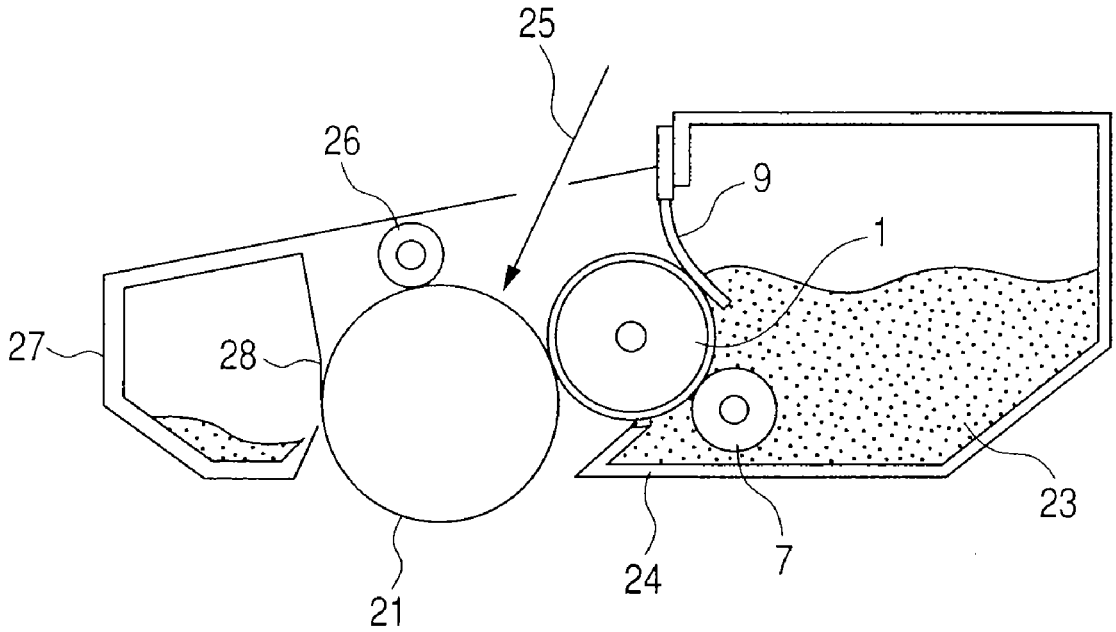
FIG. 6 is a schematic view illustrating a process cartridge having a developing roller according to the present invention mounted thereon.

A process cartridge according to the present invention is detachable from the main body of the electrophotographic image forming apparatus, and includes the developing roller according to the present invention, as described above. Here, a schematic view of one example of the process cartridge for a monochrome image forming apparatus is illustrated in FIG. 6. The developing roller 1 is mounted in a state of contacting a photosensitive member 21 and a toner-applying member 7. A toner 23 accommodated in a toner container 24 can be supplied to the developing roller 1 by the toner-applying member 7. In this case, the amount of the toner is adjusted by a toner-amount-regulating blade 9. On the other hand, an electrostatic latent image is formed on the photosensitive member 21 electrically charged with a charging member 26 by a laser light 25, and the retained electrostatic latent image is converted into a visible image by the toner which has been carried on and conveyed by the developing roller 1, to be a toner image. This toner image on the photosensitive member 21 is transferred onto a recording medium, such as paper. Then, the toner remaining on the photosensitive member 21 is scraped out and is scraped off into a waste toner container 27 by a cleaning blade 28.

EXAMPLES

The present invention will be more specifically described below by way of showing examples, but the present invention is not limited thereto.

In addition, the purity of used reagents is 99.5% or more unless otherwise specified, except those which are described below.

(1) Rubber Raw Material for Elastic Layer

Liquid silicone rubber: dimethylpolysiloxane having a vinyl group at both ends, (in which vinyl group content was 0.15 mass %), and a dimethylsiloxane-methylhydrogensiloxane copolymer having a Si—H group at both ends were used (in which the content of H bonded to Si atoms was 0.30%). A complex (0.5 mass %) of chloroplatinic acid and divinyltetramethyldisiloxane was used as a curing catalyst.

Olefin-based elastomer "Santoprene 8211-25" (which is trade name and is made by Advanced Elastomer Systems Japan Ltd.), Olefin-based elastomer "Santoprene 8211-45" (which is trade name and is made by Advanced Elastomer Systems Japan Ltd.), Low density polyethylene (LDPE) "NOVATEC LD LJ902" (which is trade name and is made by Japan Polyethylene Corporation), LDPE "NOVATEC LD LJ802" (which is trade name and is made by Japan Polyethylene Corporation), and Ethylene-vinyl acetate copolymer (EVA) "EVAFLEX EV45LX" (which is trade name and is made by DUPONT-MITSUI POLYCHEMICALS CO., LTD.).

(2) Other Components for Elastic Layer;

Quartz powder "Min-USil" (which is trade name and is made by Pennsylvania Glass Sand Corporation), Carbon black "DENKA BLACK" (which is trade name, is made by DENKI KAGAKU KOGYO KABUSHIKI KAISHA and is powdery product), and MT carbon black "Thermax N990" (which is a trade name and is made by Cancarb Ltd.).

Production Example 1

Production of Elastic Roller (A)

Fillers of 7 parts by mass of a quartz powder "Min-USil" (trade name) and 10 parts by mass of carbon black "DENKA BLACK" (trade name) were blended with 100 parts by mass of dimethylpolysiloxane having a vinyl group at both ends, (in which vinyl group content was 0.15 mass %). This blended material was mixed and defoamed by using a planetary mixer, and was used as a base material of liquid silicone rubber. A solution (A) was obtained by blending 0.5 parts by mass of a complex of chloroplatinic acid and divinyltetramethyldisiloxane, which functions as a curing catalyst, with this base material. In addition, a solution (B) was obtained by blending 1.5 parts by mass of a dimethylsiloxane-methylhydrogensiloxane copolymer having a Si—H group at both ends, (in which the content of H bonded to Si atoms is 0.30%), with the above described base material.

On the other hand, a columnar mandrel which was made from an SUM material, had a diameter of 6 mm and a length of 250 mm and had a surface treated with a primer, was arranged in the center of a cylindrical die. A mixture solution was prepared by mixing the above described solution (A) and solution (B) in a mass ratio of 1:1 with the use of a static mixer, and was injected into the inner part of the above described cylindrical die. Then, the mixture solution was cured by heating the cylindrical die at a temperature of 130° C. for 20 minutes, and further post-cured at a temperature of 200° C. for 4 hours, and an elastic roller (A) having an elastic layer with a length of 240 mm and a thickness of 3 mm was obtained.

Production Example 2

Production of Elastic Roller (B)

The following materials were kneaded and pelletized by using a twin screw extruder with a diameter of 30 mm and an L/D (effective length of screw/diameter of screw) of 32, and a resin composition was obtained.

Polyolefin-based elastomer "Santoprene 8211-25" (trade name): 100 parts by mass, and MT carbon black "Thermax Floform N990" (trade name): 40 parts by mass.

A resin layer formed of the above described resin composition was formed on the peripheral surface of a mandrel (with diameter of 6 mm and length of 250 mm) by crosshead-extrusion-molding the above described resin composition. An elastic roller (B) having an elastic layer with the thickness of 3 mm was obtained, by cutting the ends of this resin layer and further grinding the resin layer portion with a rotary grinding stone.

Production Example 3

Production of Elastic Roller (C)

An elastic roller C was obtained in a similar way to that in the Production Example 2, except that an olefin-based elastomer "Santoprene 8211-45" (trade name) was used in place of the polyolefin-based elastomer "Santoprene 8211-25" (trade name).

Production Example 4

Production of Elastic Roller (D)

An elastic roller (D) was obtained in a similar way to that in the above Production Example 2, except that LDPE "NOVATEC LD LJ902" (trade name) was used in place of the polyolefin-based elastomer "Santoprene 8211-25" (trade name).

Production Example 5

Production of elastic Roller (E)

An elastic roller (E) was obtained in a similar way to that in the Production Example 2, except that LDPE "NOVATEC LD LJ802" (trade name) was used in place of the polyolefin-based elastomer "Santoprene 8211-25" (trade name).

Production Example 6

Production of Elastic Roller (F)

An elastic roller (F) was obtained in a similar way to that in the Production Example 2, except that an EVA "EVAFLEX EV45LX" (trade name) was used in place of the polyolefin-based elastomer "Santoprene 8211-25" (trade name).

Example 1

A elastic roller (A) which was obtained in Production Example 1 was placed in a plasma CVD apparatus illustrated in FIG. 3, and then the pressure in the vacuum chamber was reduced to 0 Pa (gauge pressure, hereinafter the same) by using a vacuum pump. Subsequently, a mixture gas of 20 sccm of hexamethyldisilazane vapor and 200 sccm of nitrogen, which was a raw material gas, was introduced into the vacuum chamber, and the pressure in the vacuum chamber was adjusted so as to be 41 Pa. After the pressure became constant, an electric power of 200 W with a frequency of 13.56 MHz was supplied to plate electrodes from a high-frequency power source to generate plasma in between the electrodes. The elastic roller (A) which was installed in the vacuum chamber was rotated at 10 rpm and was treated for 300 minutes. After the treatment was finished, power supply was stopped, the raw material gas remaining in the vacuum chamber was exhausted, and air was introduced into the vacuum chamber until the inner pressure reached atmospheric pressure. Then, the developing roller having a surface layer formed thereon was taken out.

As a result of having determined the total amount of the existing elements Si, N, C and H with respect to all elements existing in the surface layer of the obtained developing roller by using an X-ray photoelectron spectrometer and an elastic recoil particle detector, the total amount was 94.67% and the amount of oxygen was 5.33%. In addition, N/Si, C/Si and H/Si were 0.75, 0.90 and 0.28, respectively.

In addition, as a result of having measured the film thickness of the surface layer of the developing roller by using a thin film measuring apparatus "F20-EXR" (trade name), the film thickness was 1,652 nm. In the above description, film thicknesses were measured at nine spots in total of three spots equally divided in the peripheral direction of the developing roller for each of three spots equally divided in the lengthwise direction, the average value of the obtained values was determined as the film thickness.

Furthermore, the current value of the developing roller was measured by applying a voltage of 50 V to the developing roller, rotating the developing roller at a speed of 24 rpm in an environment set at a temperature of 20° C. and a humidity of 50% RH, and was found to be 280 μA.

A test piece 40 for the measurement of elongation modulus was prepared from the developing roller so as to have the length of 100 mm and correspond to the half of the perimeter of the roller according to FIG. 2. The elongation modulus of the elastic layer having the surface layer (hereinafter referred to as "elastic layer+surface layer") was measured by using this test piece, and found to be 1.0 MPa. In the above description, the elongation modulus was measured on five specimens by using a universal tensile tester "TENSILON RTC-1250A" (trade name) in a measurement environment with a temperature of 20±3° C. and a humidity of 60%±10% RH, and the elongation modulus was determined to be an average value of the measured values.

Example 2

A developing roller was obtained by performing the treatment under the same conditions as in Example 1 except that in the formation of a surface layer, a mixture gas of 20 sccm of hexamethyldisilazane vapor, 100 sccm of nitrogen and 50 sccm of oxygen, which was a raw material gas, was introduced into the vacuum chamber, and that the pressure in the vacuum chamber was adjusted so as to be 38 Pa.

As a result of having determined the total amount of the existing elements Si, N, C and H with respect to all elements existing on the surface of the obtained developing roller by using an X-ray photoelectron spectrometer and an elastic recoil particle detector, the total amount was 90.12% and the amount of oxygen was 9.88%. N/Si, C/Si and H/Si, were 1.00, 0.30 and 0.19, respectively. In addition, the film thickness of the surface layer was 2,153 nm, and the current value of the developing roller was 354 μA. Furthermore, the elongation modulus of the elastic layer+surface layer was 1.0 MPa.

Example 3

A developing roller was obtained by treating a developing roller in the same condition as in Example 1 except that in the formation of a surface layer, 20 sccm of hexamethyldisilazane vapor which was a raw material gas was introduced into the vacuum chamber, and that the pressure in the vacuum chamber was adjusted so as to be 4 Pa.

As a result of having determined the total amount of the existing elements Si, N, C and H with respect to all elements existing on the surface of the obtained developing roller by using an X-ray photoelectron spectrometer and an elastic recoil particle detector, the total amount was 95.37% and the amount of oxygen was 4.63%. N/Si, C/Si and H/Si, were 0.26, 1.43 and 0.15, respectively. In addition, the film thickness of the surface layer was 1,696 nm, and the current value of the developing roller was 12 μA. Furthermore, the elongation modulus of the elastic layer+surface layer was 1.0 MPa.

Example 4

A treated developing roller was obtained by performing the treatment under the same conditions as in Example 1 except that in the formation of a surface layer, a mixture gas of 20 sccm of hexamethyldisilazane vapor and 200 sccm of ammonia, which was a raw material gas, was introduced into the vacuum chamber, and that the pressure in the vacuum chamber was adjusted so as to be 42 Pa.

As a result of having determined the total amount of the existing elements Si, N, C and H with respect to all elements existing on the surface of the obtained developing roller by using an X-ray photoelectron spectrometer and an elastic recoil particle detector, the total amount was 98.12% and the amount of oxygen was 1.88%. N/Si, C/Si and H/Si, were 0.75, 0.93 and 0.35, respectively. In addition, the film thickness of the surface layer was 2,243 nm, and the current value of the developing roller was 112 μA. Furthermore, the elongation modulus of the elastic layer+surface layer was 1.0 MPa.

Example 5

A developing roller was obtained by performing the treatment under the same conditions as in Example 3 except that in the formation of a surface layer, an electric power of 150 W was supplied to plate electrodes from a high-frequency power source to generate plasma in between the electrodes.

As a result of having determined the total amount of the existing elements Si, N, C and H with respect to all elements existing on the surface of the obtained developing roller by using an X-ray photoelectron spectrometer and an elastic recoil particle detector, the total amount was 93.37% and the amount of oxygen was 6.63%. N/Si, C/Si and H/Si, were 0.43, 1.50 and 0.35, respectively. In addition, the film thickness of the surface layer was 985 nm, and the current value of the developing roller was 243 μA. Furthermore, the elongation modulus of the elastic layer+surface layer was 1.0 MPa.

Example 6

A developing roller was obtained by performing the treatment under the same conditions as in Example 3 except that in the formation of a surface layer, the period of time taken for plasma CVD treatment was set at 150 seconds.

As a result of having determined the total amount of the existing elements Si, N, C and H with respect to all elements existing on the surface of the obtained developing roller by using an X-ray photoelectron spectrometer and an elastic recoil particle detector, the total amount was 91.85% and the amount of oxygen was 8.15%. N/Si, C/Si and H/Si, were 0.20, 1.50 and 0.21, respectively. In addition, the film thickness of the surface layer was 562 nm, and the current value of the developing roller was 442 μA. Furthermore, the elongation modulus of the elastic layer+surface layer was 1.0 MPa.

Example 7

A developing roller was obtained by performing the treatment under the same conditions as in Example 1 except that in the formation of a surface layer, the period of time taken for plasma CVD treatment was set at 600 seconds.

As a result of having determined the total amount of the existing elements Si, N, C and H with respect to all elements existing on the surface of the obtained developing roller by using an X-ray photoelectron spectrometer and an elastic recoil particle detector, the total amount was 99.87% and the amount of oxygen was 0.13%. N/Si, C/Si and H/Si, were 0.76, 0.94 and 0.31, respectively. In addition, the film thickness of the surface layer was 2,989 nm, and the current value of the developing roller was 8 μA. Furthermore, the elongation modulus of the elastic layer+surface layer was 1.0 MPa.

Example 8

A developing roller was obtained by performing the treatment under the same conditions as in Example 4 except that in the formation of a surface layer, an elastic roller (A) was changed to an elastic roller (B) produced in Production Example 2, an electric power of 150 W was supplied to plate electrodes from a high-frequency power source to generate plasma in between the electrodes, and that the period of time taken for plasma CVD treatment was set at 30 seconds.

As a result of having determined the total amount of the existing elements Si, N, C and H with respect to all elements existing on the surface of the obtained developing roller by using an X-ray photoelectron spectrometer and an elastic recoil particle detector, the total amount was 98.14% and the amount of oxygen was 1.86%. N/Si, C/Si and H/Si, the values were 0.83, 1.47 and 0.24, respectively. In addition, the film thickness of the surface layer was 15 nm, and the current value of the developing roller was 5,000 μA. Furthermore, the elongation modulus of the elastic layer+surface layer was 10.0 MPa.

Example 9

A developing roller was obtained by performing the treatment under the same conditions as in Example 4 except that in the formation of a surface layer, an elastic roller (A) was changed to an elastic roller (C) produced in Production Example 3, and the period of time taken for plasma CVD treatment was set at 600 seconds.

As a result of having determined the total amount of the existing elements Si, N, C and H with respect to all elements existing on the surface of the obtained developing roller by using an X-ray photoelectron spectrometer and an elastic recoil particle detector, the total amount was 99.17% and the amount of oxygen was 0.83%. N/Si, C/Si and H/Si, were 0.78, 0.94 and 0.26, respectively. In addition, the film thickness of the surface layer was 4,997 nm, and the current value of the developing roller was 5 μA. Furthermore, the elongation modulus of the elastic layer+surface layer was 30.0 MPa.

Example 10

A developing roller was obtained by performing the treatment under the same conditions as in Example 1 except that an elastic roller (A) was changed to an elastic roller (D) produced in Production Example 4.

As a result of having determined the total amount of the existing elements Si, N, C and H with respect to all elements existing on the surface of the obtained developing roller by using an X-ray photoelectron spectrometer and an elastic recoil particle detector, the total amount was 90.97% and the amount of oxygen was 9.03%. N/Si, C/Si and H/Si, were 0.69, 1.00 and 0.33, respectively. In addition, the film thickness of the surface layer was 300 nm, and the current value of the developing roller was 1,110 μA. Furthermore, the elongation modulus of the elastic layer+surface layer was 100.0 MPa.

Example 11

A developing roller was obtained by performing the treatment under the same conditions as in Example 4 except that an elastic roller (A) was changed to an elastic roller (E) produced in Production Example 5.

As a result of having determined the total amount of the existing elements Si, N, C and H with respect to all elements existing on the surface of the obtained developing roller by using an X-ray photoelectron spectrometer and an elastic recoil particle detector, the total amount was 98.00% and the amount of oxygen was 2.00%. N/Si, C/Si and H/Si, were 0.80, 0.97 and 0.33, respectively. In addition, the film thickness of the surface layer was 2,118 nm, and the current value of the developing roller was 886 μA. Furthermore, the elongation modulus of the elastic layer+surface layer was 110.0 MPa.

Example 12

A developing roller was obtained by performing the treatment under the same conditions as in Example 1 except that an elastic roller (A) was changed to an elastic roller (F) produced in Production Example 6.

As a result of having determined the total amount of the existing elements Si, N, C and H with respect to all elements existing on the surface of the obtained developing roller by using an X-ray photoelectron spectrometer and an elastic recoil particle detector, the total amount was 97.53% and the amount of oxygen was 2.47%. N/Si, C/Si and H/Si, were 0.86, 0.97 and 0.30, respectively. In addition, the film thickness of the surface layer was 1,822 nm, and the current value of the developing roller was 367 μA. Furthermore, the elongation modulus of the elastic layer+surface layer was 0.7 MPa.

Example 13

A developing roller was obtained by performing the treatment under the same conditions as in Example 1 except that in the formation of a surface layer, a mixture gas of 40 sccm of hexamethyldisilazane vapor and 200 sccm of nitrogen, which was a raw material gas, was introduced into the vacuum chamber, that the pressure in the vacuum chamber was adjusted so as to be 45 Pa, and further that the period of time taken for plasma CVD treatment was set at 500 seconds.

As a result of having determined the total amount of the existing elements Si, N, C and H with respect to all elements existing on the surface of the obtained developing roller by using an X-ray photoelectron spectrometer and an elastic recoil particle detector, the total amount was 90.78% and the amount of oxygen was 9.22%. N/Si, C/Si and H/Si, were 1.00, 0.74 and 0.33, respectively. In addition, the film thickness of the surface layer was 5,523 nm, and the current value of the developing roller was 2 μA. Furthermore, the elongation modulus of the elastic layer+surface layer was 1.0 MPa.

Example 14

A developing roller was obtained by performing the treatment under the same conditions as in Example 1 except that in the formation of a surface layer, a mixture gas of 10 sccm of hexamethyldisilazane vapor and 100 sccm of ammonia was introduced into the vacuum chamber, that the pressure in the vacuum chamber was adjusted so as to be 18 Pa, further that an electric power of 150 W was supplied to plate electrodes from a high-frequency power source, and that the period of time taken for plasma CVD treatment was set at 30 seconds.

As a result of having determined the total amount of the existing elements Si, N, C and H with respect to all elements existing on the surface of the obtained developing roller by using an X-ray photoelectron spectrometer and an elastic recoil particle detector, the total amount was 99.18% and the amount of oxygen was 0.82%. N/Si, C/Si and H/Si, were 0.65, 1.50 and 0.35, respectively. In addition, the film thickness of the surface layer was 13 nm, and the current value of the developing roller was 5,180 μA. Furthermore, the elongation modulus of the elastic layer+surface layer was 1.0 MPa.

Comparative Example 1

A developing roller was obtained by performing the treatment under the same conditions as in Example 1 except that in the formation of a surface layer, an electric power of 150 W was supplied to plate electrodes from a high-frequency power source.

As a result of having determined the total amount of the existing elements Si, N, C and H with respect to all elements existing on the surface of the obtained developing roller by using an X-ray photoelectron spectrometer and an elastic recoil particle detector, the total amount was 98.81% and the amount of oxygen was 1.19%. N/Si, C/Si and H/Si, were 0.26, 1.59 and 0.37, respectively. In addition, the film thickness of the surface layer was 1,238 nm, and the current value of the developing roller was 568 μA. Furthermore, the elongation modulus of the elastic layer+surface layer was 1.0 MPa.

Comparative Example 2

A developing roller was obtained by performing the treatment under the same conditions as in Example 1 except that in the formation of a surface layer, a mixture gas of 20 sccm of hexamethyldisiloxane vapor and 200 sccm of nitrogen, which was a raw material gas, was introduced into the vacuum chamber, and that the pressure in the vacuum chamber was adjusted so as to be 41 Pa.

As a result of having determined the total amount of the existing elements Si, N, C and H with respect to all elements existing on the surface of the obtained developing roller by using an X-ray photoelectron spectrometer and an elastic recoil particle detector, the total amount was 85.45% and the amount of oxygen was 14.55%. N/Si, C/Si and H/Si, were 1.05, 1.46 and 0.49, respectively. In addition, the film thickness of the surface layer was 5,834 nm, and the current value of the developing roller was 3 μA. Furthermore, the elongation modulus of the elastic layer+surface layer was 1.0 MPa.

Comparative Example 3

A developing roller was obtained by performing the treatment under the same conditions as in Example 1 except that in the formation of a surface layer, a mixture gas of 20 sccm of hexamethyldisilazane vapor and 400 sccm of ammonia, which was a raw material gas, was introduced into the vacuum chamber, and that the pressure in the vacuum chamber was adjusted so as to be 65 Pa.

As a result of having determined the total amount of the existing elements Si, N, C and H with respect to all elements existing on the surface of the obtained developing roller by using an X-ray photoelectron spectrometer and an elastic recoil particle detector, the total amount was 98.88% and the amount of oxygen was 1.12%. N/Si, C/Si and H/Si, were 1.44, 1.19 and 0.27, respectively. In addition, the film thickness of the surface layer was 1,135 nm, and the current value of the developing roller was 369 μA. Furthermore, the elongation modulus of the elastic layer+surface layer was 1.0 MPa.

Comparative Example 4

A developing roller was obtained by performing the treatment under the same conditions as in Example 1 except that in the formation of a surface layer, a mixture gas of 20 sccm of hexamethyldisilazane vapor and 50 sccm of oxygen, which was a raw material gas, was introduced into the vacuum chamber, and that the pressure in the vacuum chamber was adjusted so as to be 10 Pa.

As a result of having determined the total amount of the existing elements Si, N, C and H with respect to all elements existing on the surface of the obtained developing roller by using an X-ray photoelectron spectrometer and an elastic recoil particle detector, the total amount was 76.28% and the amount of oxygen was 23.72%. N/Si, C/Si and H/Si, were 0.54, 0.26 and 0.14, respectively. In addition, the film thickness of the surface layer was 1,365 nm, and the current value of the developing roller was 543 μA. Furthermore, the elongation modulus of the elastic layer+surface layer was 1.0 MPa.

Comparative Example 5

A developing roller was obtained by performing the treatment under the same conditions as in Example 1 except that in the formation of a surface layer, a mixture gas of 20 sccm of hexamethyldisiloxane vapor and 50 sccm of ammonia, which was a raw material gas, was introduced into the vacuum chamber, and that the pressure in the vacuum chamber was adjusted so as to be 10 Pa.

As a result of having determined the total amount of the existing elements Si, N, C and H with respect to all elements existing on the surface of the obtained developing roller by using an X-ray photoelectron spectrometer and an elastic recoil particle detector, the total amount was 90.55% and the amount of oxygen was 9.45%. N/Si, C/Si and H/Si, were 0.12, 1.21 and 0.35, respectively. In addition, the film thickness of the surface layer was 886 nm, and the current value of the developing roller was 485 μA. Furthermore, the elongation modulus of the elastic layer+surface layer was 1.0 MPa.

The amount of each atom, the total amount of Si, N, C and H, and the like all in each developing roller are shown in Table 1, and the evaluation results for physical properties are collectively shown in Table 2.

TABLE 1

| | Total amount (%) | Amount ratio | | | Oxygen amount |
|---|---|---|---|---|---|
| | Si + C + N + H | N/Si | C/Si | H/Si | (%) |
| Ex. 1 | 94.67 | 0.75 | 0.90 | 0.28 | 5.33 |
| Ex. 2 | 90.12 | 1.00 | 0.30 | 0.19 | 9.88 |
| Ex. 3 | 95.37 | 0.26 | 1.43 | 0.15 | 4.63 |
| Ex. 4 | 98.12 | 0.75 | 0.93 | 0.35 | 1.88 |
| Ex. 5 | 93.37 | 0.43 | 1.50 | 0.35 | 6.63 |
| Ex. 6 | 91.85 | 0.20 | 1.50 | 0.21 | 8.15 |
| Ex. 7 | 99.87 | 0.76 | 0.94 | 0.31 | 0.13 |
| Ex. 8 | 98.14 | 0.83 | 1.47 | 0.24 | 1.86 |
| Ex. 9 | 99.17 | 0.78 | 0.94 | 0.26 | 0.83 |
| Ex. 10 | 90.97 | 0.69 | 1.00 | 0.33 | 9.03 |
| Ex. 11 | 98.00 | 0.80 | 0.97 | 0.33 | 2.00 |
| Ex. 12 | 97.53 | 0.86 | 0.97 | 0.30 | 2.47 |
| Ex. 13 | 90.78 | 1.00 | 0.74 | 0.33 | 9.22 |
| Ex. 14 | 99.18 | 0.65 | 1.50 | 0.35 | 0.82 |
| Com. Ex. 1 | 98.81 | 0.26 | 1.59 | 0.37 | 1.19 |
| Com. Ex. 2 | 85.45 | 1.05 | 1.46 | 0.49 | 14.55 |
| Com. Ex. 3 | 98.88 | 1.44 | 1.19 | 0.27 | 1.12 |
| Com. Ex. 4 | 76.28 | 0.54 | 0.26 | 0.14 | 23.72 |
| Com. Ex. 5 | 90.55 | 0.12 | 1.21 | 0.35 | 9.45 |

TABLE 2

| | Film thickness (nm) | Elongation modulus (MPa) | Current value (μA) |
|---|---|---|---|
| Ex. 1 | 1652 | 1.0 | 280 |
| Ex. 2 | 2153 | 1.0 | 354 |
| Ex. 3 | 1696 | 1.0 | 12 |
| Ex. 4 | 2243 | 1.0 | 112 |
| Ex. 5 | 985 | 1.0 | 243 |
| Ex. 6 | 562 | 1.0 | 442 |
| Ex. 7 | 2989 | 1.0 | 8 |
| Ex. 8 | 15 | 10.0 | 5000 |
| Ex. 9 | 4997 | 30.0 | 5 |
| Ex. 10 | 300 | 100.0 | 1110 |
| Ex. 11 | 2118 | 110.0 | 886 |
| Ex. 12 | 1822 | 0.7 | 367 |
| Ex. 13 | 5523 | 1.0 | 2 |
| Ex. 14 | 13 | 1.0 | 5180 |
| Com. Ex. 1 | 1238 | 1.0 | 568 |
| Com. Ex. 2 | 5834 | 1.0 | 3 |
| Com. Ex. 3 | 1135 | 1.0 | 369 |
| Com. Ex. 4 | 1365 | 1.0 | 543 |
| Com. Ex. 5 | 886 | 1.0 | 485 |

<Evaluation 1>

Each of the developing rollers which were obtained in the above described Examples and Comparative Examples was incorporated in a cartridge of an electrophotographic laser printer "Color Laser Jet3600" (which is trade name and is made by Hewlett-Packard Company) as a developing roller. An electrostatic latent image was developed with the toner by using this cartridge, and electrophotographic images were output in an environment of a temperature of 25° C. and a humidity of 50% RH. Afterward, the obtained image was subjected to the following evaluations. The evaluation results are shown in Table 3. The laser printer "Color Laser Jet3600" which was used here is a machine for outputting A4 paper in its longitudinal direction, which outputs a recording medium at an output speed of 16 ppm. The contact pressure and intruding quantity of the developing roller to the toner-regulating member were set so that the amount of the toner carried on the developing roller was 0.35 mg/cm$^2$. The image was evaluated by using a solid black image and a solid white image output after having output an initial solid black image and a halftone image, and then having carried out a durability test of 6,000 sheets of copies, by using a Black BK toner.

(Fogging)

Reflection density was measured on a solid white image obtained after 6,000 sheets were output, by a photovoltaic reflection densitometer "TC-6DS/A" (which is trade name and is made by Tokyo Denshoku Co., Ltd.). The difference of reflection density between the solid white image and an unprinted portion was defined as fogging (%), which was evaluated according to the following criteria:

"A": being less than 1.5%.

"B": being 1.5% or more and less than 3.0%.

"C": being 3.0% or more.

(Ghost)

The ghost level was determined by visually evaluating whether the non-uniformity of density occurred or not in a halftone part, on a ghost assessment pattern (pattern of sequentially forming solid image and halftone image of 15 mm square within one sheet of image) obtained after 6,000 sheets were output.

"A": causing no ghost.

"B": causing slight ghost but no problem for the image.

"C": causing ghost.

(Bleeding Properties)

The effect the surface layer according to the present invention exerted on the inhibition of bleeding of a low-molecular-weight substance from the elastic layer in the developing roller was tested in the following way.

A new developing roller prepared in each of the Examples and Comparative Examples was incorporated in a process cartridge, and the process cartridge was left in a state of having made the developing roller contact the toner-amount-regulating blade and the photosensitive drum, in an environment of 40° C. and 95% RH for 30 days. Subsequently, the process cartridge after having been left was incorporated in a laser printer, and a solid black image and a halftone image were output. The output images were visually observed, and the presence or absence and the extent of the occurrence of defects in the electrophotographic images caused by an adherence of a substance having bled from the elastic layer to the photosensitive drum were evaluated according to the following criteria:

"None": causing no image defect due to adherence of bleeding materials.

"Slight": practically causing no problem, though slight image defects caused by adherence of bleeding materials can be observed.

"Present": causing observable image defects due to adherence of bleeding materials.

(Peeling of Surface Layer)

It was confirmed whether the peeling of the surface layer could be observed or not when having observed the surface of the developing roller with a digital microscope "VHX-500" (which is trade name and is made by KEYENCE CORPORATION), after all of the images used for the evaluation were output, and the degree of peeling was evaluated according to the following criteria:

"None": causing no peeling of the surface layer.

"Slight": practically causing no problem though slight peeling of the surface layer is observed.

"Present": causing observable peeling of the surface layer.

TABLE 3

| | Fogging | Ghost | Bleeding properties | Peeling of surface layer |
|---|---|---|---|---|
| Ex. 1 | A | A | None | None |
| Ex. 2 | A | B | Slight | None |
| Ex. 3 | A | A | Slight | None |
| Ex. 4 | A | A | None | Slight |
| Ex. 5 | A | A | None | Slight |
| Ex. 6 | B | A | None | Slight |
| Ex. 7 | A | A | None | None |
| Ex. 8 | A | A | None | None |
| Ex. 9 | A | A | None | None |
| Ex. 10 | A | A | None | None |
| Ex. 11 | A | A | None | None |
| Ex. 12 | A | A | None | None |
| Ex. 13 | A | B | None | None |
| Ex. 14 | A | A | None | Slight |
| Com. Ex. 1 | A | A | None | Present |
| Com. Ex. 2 | A | C | Present | Present |
| Com. Ex. 3 | A | C | None | None |
| Com. Ex. 4 | A | A | Present | None |
| Com. Ex. 5 | C | A | None | None |

As is shown in Table 3, it was found from the result of the fogging and the ghost observations that the developing roller according to the present invention had a surface layer which could impart an appropriate electric charge to a toner. It was also found from the result of the bleeding properties that the developing roller according to the present invention had a surface layer uniformly formed on an elastic layer and further that the formed surface layer had sufficient flexibility. Furthermore, it was found from the result of the peeling of the surface layer that the developing roller according to the present invention had excellent adhesiveness and caused no problem in use for a long period of time.

<Evaluation 2>

Next, the developing roller which was obtained in the above described Examples and Comparative Examples was further subjected to the following evaluations. The evaluation results are shown in Table 4.

(Filming)

After all of the images used for the evaluation were output, the surface of the developing roller was observed, and filming was evaluated from a state of causing filming and an observation result for the last image for evaluation according to the following criteria.

"A": causing no filming on the developing roller.

"B": causing no problem in the image, but causing slight filming on the developing roller.

"C": causing haze on image due to influence of toner having adhered onto the developing roller.

(Density Nonuniformity)

Density nonuniformity was visually observed on an initial solid black image and halftone image, and was evaluated according to the following criteria. For information, the density nonuniformity is most easily observable in a halftone image and is relatively easily observable in a solid black image.

"A": showing good image without causing visually observable density nonuniformity in any image.

"B": causing observable density nonuniformity in the halftone image, but causing no observable density nonuniformity in the solid black image.

"C": causing observable density nonuniformity in any image.

(Image Density)

The densities of an initial solid black image and a solid black image obtained after 6,000 sheets had been output were measured by using a Macbeth densitometer "Macbeth Color Checker RD-918" (which is trade name and is made by Macbeth), and was evaluated according to the following criteria:

"A": being 1.3 or more in any image.

"B": being 1.3 or more in one image, but being less than 1.3 in the other image.

"C": being less than 1.3 in any image.

(Transverse Streak)

It was visually confirmed whether intense transverse streaks corresponding to the position of a pin hole formed in a previously-prepared photosensitive drum were formed or not on the initial solid black image and the halftone image, and the grade was evaluated according to the following criteria:

"None": causing no observable transverse streak.

"Slight": causing no problem in the image though an observable transverse streak is slightly formed.

"Present": causing an observable transverse streak.

(Setting Properties)

A developing roller was incorporated in a process cartridge, and was left in a state of being in contact with the toner-regulating member and the photosensitive drum, in an environment of 40° C. and 95% RH for 30 days. Subsequently, the process cartridge which had been left was incorporated in a laser printer, and a solid black image and a halftone image were output. The first sheet was visually observed, and the set properties (presence or absence of the occurrence of a transverse streak due to marks caused by having been in contact with the toner-regulating member) were evaluated according to the following criteria:

"None": causing no transverse streak based on contact marks.

"Slight": causing no problem with the image though a transverse streak due to contact marks is slightly observed.

"Present": causing an observable transverse streak due to contact marks.

The results of the above described evaluation items are shown in Table 4.

TABLE 4

| | Filming | Density nonuniformity | Image density | Transverse streak | Setting |
|---|---|---|---|---|---|
| Ex. 1 | A | A | A | A | A |
| Ex. 2 | A | A | A | A | A |

TABLE 4-continued

| | Filming | Density nonuniformity | Image density | Transverse streak | Setting |
|---|---|---|---|---|---|
| Ex. 3 | A | A | A | A | A |
| Ex. 4 | A | A | A | A | A |
| Ex. 5 | A | A | A | A | A |
| Ex. 6 | A | A | A | A | A |
| Ex. 7 | A | A | A | A | A |
| Ex. 8 | B | A | A | B | A |
| Ex. 9 | A | B | B | A | A |
| Ex. 10 | B | A | A | A | A |
| Ex. 11 | C | A | A | A | A |
| Ex. 12 | A | A | A | A | C |
| Ex. 13 | A | C | C | A | A |
| Ex. 14 | C | A | A | C | A |
| Com. Ex. 1 | A | A | A | A | A |
| Com. Ex. 2 | A | C | C | A | A |
| Com. Ex. 3 | A | A | A | A | A |
| Com. Ex. 4 | A | A | A | A | A |
| Com. Ex. 5 | A | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-215267, filed Aug. 25, 2008, which is hereby incorporated by reference herein in its entirety.

What is claimed is:

1. A developing roller comprising:

a mandrel;

at least one layer of an elastic layer provided on the mandrel; and a surface layer provided on the elastic layer, which carries and conveys a toner, and develops an electrostatic latent image on an opposing photosensitive member with the toner, wherein the surface layer comprises a silicon compound film containing Si, N, C and H, and in the surface layer: the proportion of the total number of the elements of Si, N, C and H, with respect to all elements contained in the surface layer, as measured by X-ray photoelectron spectroscopy and elastic recoil detection analysis, is 90.00% or more, and the abundance ratio N/Si of N to Si in the surface layer is in the range from 0.20 or more to 1.00 or less, the abundance ratio C/Si of C to Si in the surface layer is in the range from 0.30 or more to 1.50 or less, and the abundance ratio H/Si of H to Si in the surface layer is in the range from 0.15 or more to 0.35 or less.

2. The developing roller according to claim 1, wherein the surface layer contains an oxygen atom.

3. The developing roller according to claim 1, wherein the film thickness of the surface layer is in the range from 15 nm or more to 5,000 nm or less.

4. The developing roller according to claim 3, wherein the film thickness of the surface layer is in the range from 300 nm or more to 3,000 nm or less.

5. The developing roller according to claim 1, wherein the elongation modulus of the elastic layer having the surface layer is in the range from 1.0 MPa or more to 100.0 MPa or less.

6. The developing roller according to claim 1, wherein the surface layer is prepared by a plasma CVD method.

7. The developing roller according to claim 1, wherein the elastic layer is made from a silicone rubber.

8. The developing roller according to claim 1, wherein the electric current value of the developing roller measured when a voltage of 50 V has been applied to the developing roller which is being rotated is in the range from 5 μA or more to 5,000 μA or less.

9. An electrophotographic process cartridge which can be detachably mounted on the main body of an electrophotographic image forming apparatus, wherein the cartridge has a developing roller according to claim 1.

10. An electrophotographic image forming apparatus having a photosensitive member for retaining an electrostatic latent image and a developing roller which can be arranged in contact with the photosensitive member, wherein the developing roller is a developing roller according to claim 1.

* * * * *